United States Patent [19]

Boisselle

[11] Patent Number: 4,884,822

[45] Date of Patent: Dec. 5, 1989

[54] SKI SPURS

[76] Inventor: René P. Boisselle, 155, Deguire Blvd., Ville St-Laurent, Quebec, Canada, H4N 1N9

[21] Appl. No.: 302,240

[22] Filed: Jan. 27, 1989

[51] Int. Cl.[4] ..... A63C 7/00

[52] U.S. Cl. ..... 280/605; 280/604

[58] Field of Search ..... 280/604, 605

[56] References Cited

U.S. PATENT DOCUMENTS

| | | | |
|---|---|---|---|
| 2,208,214 | 7/1940 | Fortune | 280/605 |
| 2,375,943 | 5/1945 | Pape | 280/604 |
| 3,724,867 | 4/1973 | Hawthorne | 280/605 |
| 4,795,183 | 1/1989 | Reuters | 280/605 |

FOREIGN PATENT DOCUMENTS

| | | | |
|---|---|---|---|
| 420145 | 5/1944 | Canada . | |
| 1058647 | 7/1979 | Canada . | |
| 2551802 | 6/1977 | Fed. Rep. of Germany | 280/605 |
| 2581321 | 11/1986 | France | 280/605 |
| 447768 | 4/1949 | Italy | 280/605 |
| 51019 | 6/1932 | Norway | 280/605 |
| 116861 | 6/1946 | Sweden | 280/605 |

*Primary Examiner*—Charles A. Marmor
*Assistant Examiner*—Brian L. Johnson
*Attorney, Agent, or Firm*—Roland L. Morneau

[57] ABSTRACT

A ski spur made of a supporting block and a horseshoe-shaped member axially supported by the block between a horizontal and a vertical position. A locking rod excentric to the axle extends between the legs of the horseshoe-shaped member of the latter and acts as a stopper on the block in both vertical and horizontal positions. The axle is preferably mounted in a substantially vertical slot provided in the block and is resiliently urged toward the ski.

7 Claims, 3 Drawing Sheets

SKI SPURS

BACKGROUND OF THE INVENTION:

1. Field of the invention:

The present invention relates to a device for preventing a ski from skidding backward while walking or climbing and in particular to spurs adapted to straddle a ski and flip on both sides thereof downwardly into the snow.

2. Prior art:

U.S. Pat. Nos. 3,724,867, 2,375,943 and 2,208,214 disclose ski spurs making use of coil springs for urging various parts of the device into desired positions. Such springs when exposed to snow or ice do not operate properly. The same applies to Canadian Patent No. 420,145. In addition, the general structure of each of these devices distinguishes from the present invention.

In Canadian Patent No. 1,058,647, the pins which are adapted to project into the snow extend into an upper bridge section defining the clamp 18, the latter being held by a remote catch member.

SUMMARY OF THE INVENTION:

The ski spur according to the invention comprises a supporting block member and a horseshoe member straddling the block member and pivotally mounted on the latter between a horizontal and a vertical position. A shaft, mounted between the legs of the horseshoe, is excentrically disposed relative to the axle around which the horseshoe is pivoting. The shaft abuts against the block member rearwardly of the axle when the horseshoe member is in a horizontal position and is releasably retained by a groove in the upper portion of the block member when the horseshoe is in its vertical position.

The axle which is mounted in an upright slot containing a resilient element maintaining the axle in the lower part of the slot. The resilient element is preferably an elastomer strongly resistant to compression.

Figure 2:
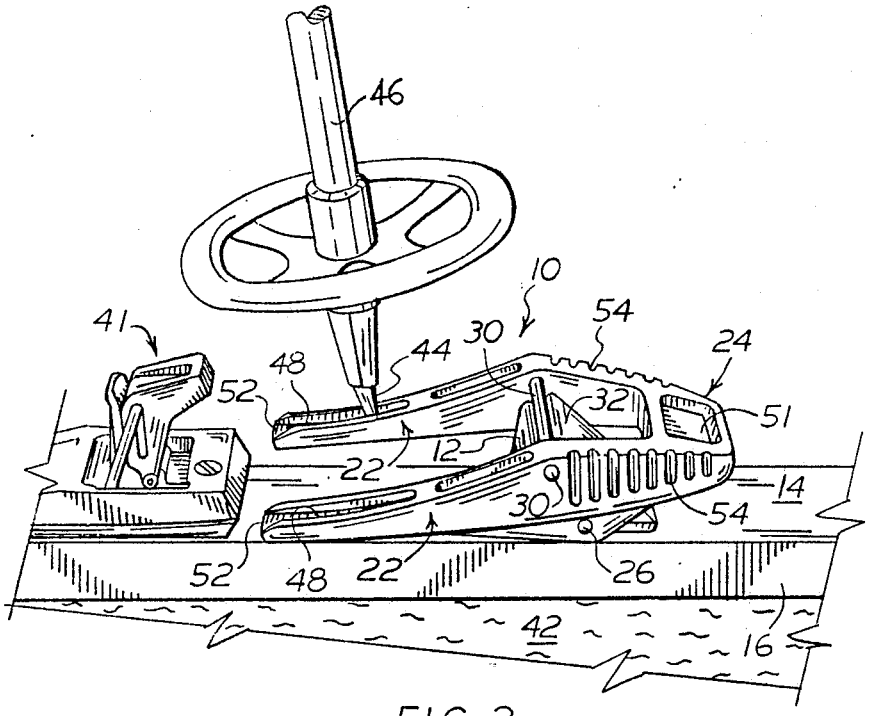
FIG. 2 is a view as shown in FIG. 1 mounted in its retracted horizontal position.

Referring to the drawings, the embodiment of the invention shows a ski spur 10 comprising a supporting block member 12 adapted to be threadedly secured on the upper surface 14 of a ski 16 through apertures 17. A horseshoe-shaped member 18 is made of two legs 22 adapted to laterally extend on each side of the ski 16 and joined at their front ends in spaced relationship by a transversal member 24 which is pivotally mounted on the supporting block member 12.

An axle 26, extending between both legs 22 and through a slot 28 provided in the supporting block member 12, allows the horseshoe-shaped member 18 to pivot between a substantially horizontal position and a substantially vertical one. A locking rod 30, extending between both legs 22 is rigidly secured to horseshoe-shaped member 18.

A transversal groove 32 is provided on the upper surface of the supporting block member 12. The groove 32 releasably retains the locking rod 30 when the horseshoe-shaped member 18 is in its substantially horizontal position. An abuting surface 38 is also provided on the supporting block member 12. The surface 38 is a ridge adapted to limit the pivoting of member 18 when the latter is in its substantially vertical position.

Resilient means such as an elastomeric block 34 is positioned inside slot 28. The elastomeric block 34 is adapted to resiliently exert pressure on axle 26, the pressure biassing the axle 26 towards the lower edge 36 of slot 28.

Figure 8:
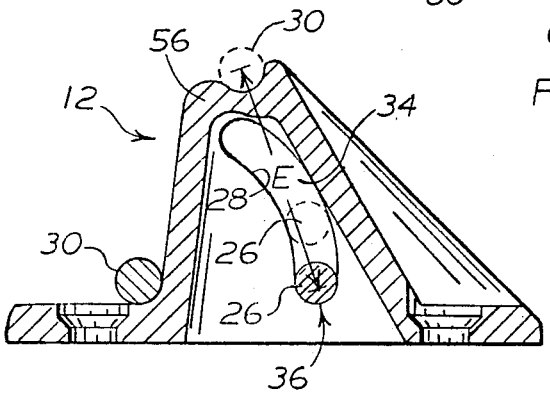
FIG. 8 is an enlarged cross-sectional view of the block member taken along line B—B of FIG. 6.

In the preferred embodiment illustrated in FIGS. 1 to 7, supporting block member 12 is substantially triangular in crosssection as illustrated in FIG. 8. The locking rod 30 is positioned rearwardly of the axle 26 and the abuting surface 38 is positioned in the lower rearward peripheral surface of the supporting block member 12. The slot 28 is vertically elongated and curved so that the radius of curvature indicated by arrow 40 in FIG. 7 corresponds to the distance between the bottom of the slot 28 and the locking rod 30 when the horseshoe-shaped member 18 is in its substantially vertical position. The letter E in FIG. 8 is used to indicate the distance between the axle 26 and the locking rod 30 when positioned in the groove 32 when the horseshoe-shaped member 18 is in its substantially horizontal position. Distance E is greater then the radius of curvature 40 of the slot 28.

In use, spur 10 is positioned on each ski preferably in front of boot fixation means 41. When skiing downhill or on a relatively flat surface with the spur in an operative position, the legs 22 extend in a horizontal position substantially parallel to the ski and above the snowy surface 42. Since the elastomeric block 34 urges the axle 26 towards the edge 36 of the slot 28, and since the distance indicated by the reference letter F in FIG. 5 between axle 26 and locking rod 30 is constant, locking rod 30 is pressured into groove 32 and horseshoe-shaped member 18 is prevented from inadvertently pivoting in an operative vertical position as shown in FIG. 2.

Whenever the skier decices to put the spur in operation with the legs 22 projecting below the ski, the tip 44 of ski pole 46 is positioned inside recess 48 provided on the upper surface of the legs 22 and pressed down to initiate a counter-clockwise movement of the horseshoe-shaped member 18. Since elastomeric block 34 is resilient, the pressure applied in recess 48 first produces an upward movement of axle 26 in the slot 28 to disengage the rod 30 from the groove 32. The horseshoe-shaped member 18 continues its counter-clockwise movement until the rod 30 to which it is rigidly linked, abuts on the surface 38.

Figure 1:
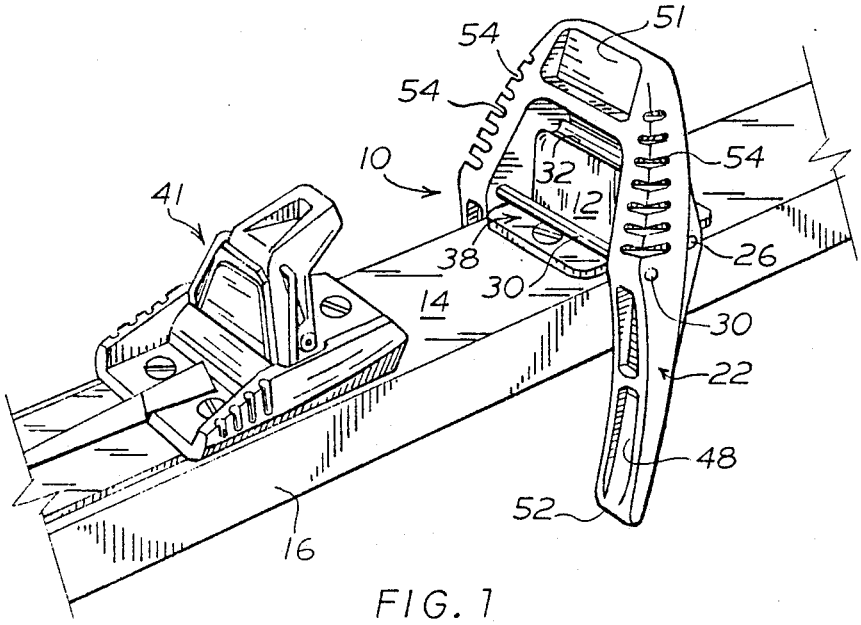
FIG. 1 is a perspective view of the ski spur according to the invention mounted on a ski with its horseshoe member in its vertical operative position.

When the applied pressure by the tip 44 is sufficient to overcome the pressure applied by the axle on the elastomeric block 34, locking rod 30 is lifted out of groove 32 and horseshoe-shaped member 18 pivots from position shown in FIG. 2 to the one shown in FIG. 1.

Once locking rod 30 is lifted out of the groove 32, the tip 52 of legs 22 will glide on the snowy surface 42. Upon a rearward movement of ski 16 as it happens when climbing a hill, tip 52 will dig into the snowy surface 42 and horseshoe-shaped member 18 will pivot to its substantially vertical position with the locking rod 30 abutting against abutting surface 38. If the tip of legs 22 is further urged in a forward direction, as it normally happens when climbing, the axle 26 will exert an upward pressure on the elastomeric block 34. This upward movement of the axle 26 inside slot 28 follows a curve which has its center of curvature in the abutting surface 38, i.e. through the locking rod 30 which, in this situation acts as pivoting means.

This rotation of axle 26 inside slot 28 and around locking rod 30 provides suspension means therefore damping sudden impacts on the legs 22 which are probably the most vulnerable components of the spur.

Once the hill is climbed and the spur is no longer needed, tip 44 of ski pole 46 is inserted into recess 51 provided on transversal bar 24. The recess 51 is used to guide and hold the tip 44 on the surface of the transversal member 24.

Upon pressure applied on the ski pole, the horseshoe-shaped member 18 is pivoted back to its original substantially horizontal position. The locking rod 30 returns to and snapped back into the transversal groove 32.

Elastomeric block 34 is preferably made up of a synthetic Thermo plastic rubber such as the one known by the trademark SANTOPRENE manufactured by Monsanto Company.

Elastomeric block 34 has a shape to fill the slot 28 and is provided with perforations 60 to insure the proper mechanical characteristics. The perforations 60 may be round and/or elongated to allow the correct compression when the rod has reached either end of its path.

The other components of spur 10 are preferably molded in light yet strong polymeric material which maintain their mechanical properties at relatively low temperatures such as Nylon reinforced with glass fibers polycarbonate or acetate.

It is also within the embodiment of the present invention to locate the transversal groove in front of the supporting block while the abutting surface may be located near the upper portion of the triangularly shaped supporting block member 12.

In yet another embodiment of the invention, the axle 26, instead of extending through slot 28 filled with a resilient material, extends through an aperture having substantially the same diameter as the axle.

The resiliency needed to insure proper snapping action of locking rod 30 into transversal groove 32 is in this case provided by the outer lip 56 of transversal groove 32 which is made up of a resilient material.

Figure 3:
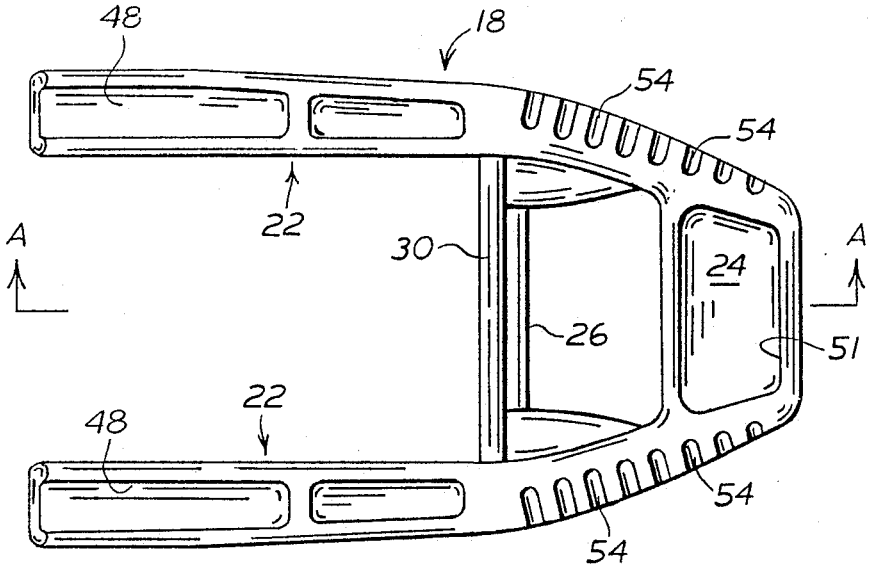
FIG. 3 is a top plan view of the horseshoe member of the spur.
Figure 6:
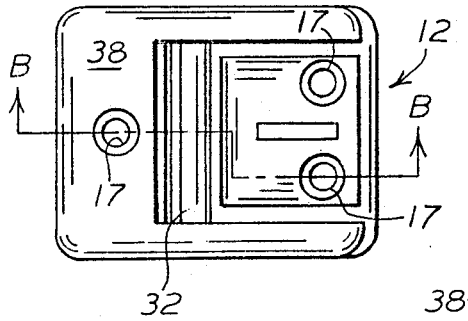
FIG. 6 is a top plan view of the block member adapted to support the horseshoe member shown in FIGS. 3 to 5.
Figure 7:
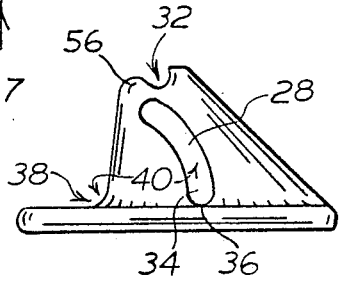
FIG. 7 is a side view of the block member shown in figure 6.
Figure 4:
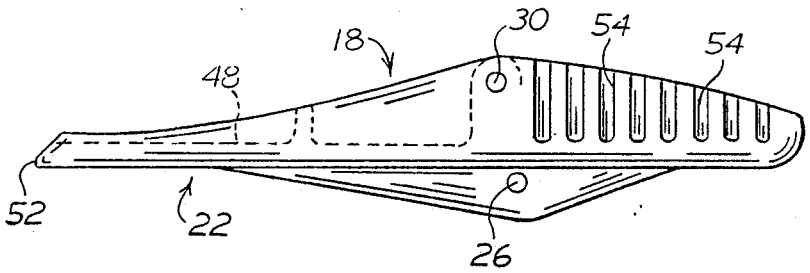
FIG. 4 is a side view of the spur show in FIG. 3.
Figure 5:
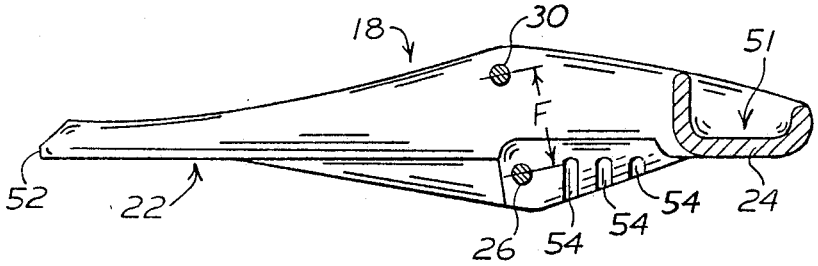
FIG. 5 is a cross-sectional view taken along line A—A of FIG. 3.
Figure 9:
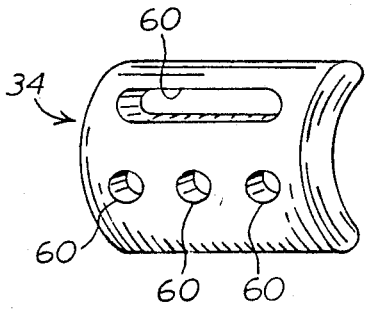
FIG. 9 is a perspective view of an elastomer body to be located in the slot of the block member.

The recesses 54 illustrated in FIGS. 3 to 5 are provided to insure both rigidity and lightness of the horseshoe-shaped component.

Although the locking rod member 30 is spaced from the transversal member 24, it is within the embodiment of the invention to make the rod member an integral part of the transversal member.

I claim:

1. A ski spur for preventing a ski having an upper and a lower face interconnected by lateral sides from skidding backward, said spur comprising a supporting block member adapted to be secured on the upper face of the ski, said block member having an upper surface and a rear surface adapted to face the back of the ski, said upper surface being provided with a transversal groove and a rear surface being provided with an abutting surface means, a horseshoe-shaped member pivotally mounted about an axle extending through a transversal slot provided in said block member, said horseshoe-shaped member adapted to rotate between a substantially horizontal and a substantially vertical position, said horseshoe-shaped member having two legs adapted to laterally extend along the lateral sides of the ski, and a locking rod member extending between said legs adapted to releasably and resiliently snap into said transversal groove when said horseshoe-shaped member is in its substantially horizontal position with the legs projecting backwardly and to abut against said abutting surface means when said horseshoe-shaped member is in its substantially vertical position, said legs projecting below the lower surface of the ski, said slot being upwardly elongated in said block member, a compressible body disposed in said slot above said axle, said body adapted to urge said axle away from said transversal groove when said locking rod member is positioned in said transversal groove.

2. A ski spur as recited in claim 1, wherein said compressible body is an elastomer.

3. A ski spur as recited in claim 2, wherein the locking rod is located relative to the axle, to act as a pivoting axis for the horseshoe-shaped member when the latter is in its vertical position and when the legs are urged in a forward direction to prevent backwards skidding of the ski.

4. A ski spur as recited in claim 2, comprising a transversal member between said legs, wherein at least a portion of a surface of said legs and of said transversal member facing upwardly when the horseshoe-shaped member is in its horizontal position, is recessed.

5. A ski spur as recited in claim 2, wherein said elastomeric body is provided with perforations.

6. A ski spur as recited in claim 2, wherein said slot is curved along a plane equidistant from, said locking rod when the horseshoe-member is in its vertical position.

7. A ski spur as recited in claim 6, wherein the position of said groove relative to said slot is predetermined so that the axle compresses the compressible body when the locking rod member is in the groove.

* * * * *